US007596900B2

(12) United States Patent
Robinson et al.

(10) Patent No.: US 7,596,900 B2
(45) Date of Patent: Oct. 6, 2009

(54) MULTI-CALIBER AMBIDEXTROUSLY CONTROLLABLE FIREARM

(75) Inventors: Alexander J. Robinson, Salt Lake City, UT (US); Darin G. Nebeker, Kaysville, UT (US); Jon C. Holway, Eagle Mountain, UT (US)

(73) Assignee: RMDI, L.L.C., Salt Lake City, UT (US)

( * ) Notice: Subject to any disclaimer, the term of this patent is extended or adjusted under 35 U.S.C. 154(b) by 562 days.

(21) Appl. No.: 10/911,963

(22) Filed: Aug. 4, 2004

(65) Prior Publication Data

US 2006/0156606 A1 Jul. 20, 2006

Related U.S. Application Data

(60) Provisional application No. 60/492,378, filed on Aug. 4, 2003.

(51) Int. Cl.
*F41A 9/61* (2006.01)

(52) U.S. Cl. ..... 42/7; 42/50; 42/49.01; 89/138; 89/1.4

(58) Field of Classification Search ..... 42/7, 42/50, 49.01; 89/138, 1.4
See application file for complete search history.

(56) References Cited

U.S. PATENT DOCUMENTS 4,128,042 A * 12/1978 Atchisson ..... 89/138
4,231,177 A * 11/1980 Foote ..... 42/16
4,326,353 A 4/1982 Ludwig et al.
4,429,479 A 2/1984 Johnson
4,521,985 A 6/1985 Smith et al.
4,599,818 A 7/1986 Fedora et al.
4,713,902 A 12/1987 Wigton
4,759,144 A 7/1988 Egan et al.
4,835,892 A 6/1989 Ruger et al.
5,519,954 A 5/1996 Garrett
5,588,241 A * 12/1996 Hurley ..... 42/50
5,900,577 A * 5/1999 Robinson et al. ..... 89/191.01
6,070,352 A * 6/2000 Daigle ..... 42/49.02
6,101,918 A * 8/2000 Akins ..... 89/129.01
6,510,778 B1 * 1/2003 Irwin ..... 89/138
7,219,462 B2 * 5/2007 Finn ..... 42/49.01
2003/0089014 A1 5/2003 Schuerman

FOREIGN PATENT DOCUMENTS

WO WO 2005047804 A2 * 5/2005

* cited by examiner

*Primary Examiner*—Michelle Clement
(74) *Attorney, Agent, or Firm*—John R. Thompson; Stoel Rives LLP

(57) ABSTRACT

A multi-caliber ambidextrously controlled firearm that includes an adjustable ejection system to facilitate the ejection of spent cartridge casings from a firearm. The adjustable ejection system includes an ejection port defined by an aperture in the firearm and a deflector. The deflector is attached to the firearm to adjust the size of the ejection port and may be attached at one of at least two attachment positions of the firearm. The adjustable ejector system includes an ejector selectively attached to the firearm at one of at least two ejector attachment positions. The improved firearm also includes an ambidextrous magazine catch system for selectively retaining a magazine within a firearm. The magazine catch system includes a first button opposite a second button such that either button may be actuated by a user to release the magazine retained with the firearm.

25 Claims, 10 Drawing Sheets

MULTI-CALIBER AMBIDEXTROUSLY CONTROLLABLE FIREARM

CROSS-REFERENCED RELATED APPLICATIONS

This application claims the benefit of U.S. Provisional Application No. 60/492,378, filed Aug. 4, 2003.

BACKGROUND OF THE INVENTION

The present invention relates to firearms. More specifically, the present invention relates to firearms that can be configured to fire different calibers of ammunition with improved reliability in harsh environmental and firing conditions. In addition, the invention relates to improved modularity of firearm systems and ambidextrous control.

The U.S. Government has been and will be involved in many conflicts and operations worldwide. Each of these conflicts and operations present their own individual circumstances and challenges that must be met by soldiers relying on firearms. To optimize the chances of success in each conflict and operation, a variety of firearms are needed to perform a variety of functions that change according to the specific circumstances of each operation and conflict. These functions range from long range sniping to close quarter battle. In addition, these functions include the use of different calibers and different configurations of firearms.

Presently, armies around the world field a variety of different firearms to fulfill each of these functions. For instance, soldiers may use an H&K MP5 for close quarter combat, an M16 for general combat, or a Barrett Model 82A1 for support fire. These different firearms have differently positioned systems that require different training to effectively use and maintain each type of firearm. However, a soldier is unlikely to carry more than one firearm into combat, because of the weight and bulk of an additional firearm with accessories and ammunition. It is this inability to optimize and adapt a firearm to the circumstances and functions of the operational environment that is a great disadvantage of known firearms.

It should be noted that there are some firearms known in the art that are capable of firing different calibers by changing the barrel, and other components without a gun-smith or tools. For example, the recoil operated H&K Model 21 and 23 series firearms are capable of firing several different cartridges, specifically 7.62 NATO, 5.56 NATO and 7.62×39 mm, by changing out the barrel, the feed attachment device (magazine well or belt feed device), and bolt. The Belgian FN Model "D" BAR Rifle is similarly capable of firing different calibers including 30.06 Springfield and 8 mm Mauser. Additionally, the M96 EXPEDITIONARY is also capable of firing 7.62×39 mm in addition to 5.56 NATO by changing the barrel, and other components.

However, a significant disadvantage of known firearms is that the position of a selector switch, magazine release, and bolt hold open on a firearm are positioned differently in different configurations and on different firearms, which requires the user to take time to adapt to each configuration to smoothly handle a firearm without mistakes. In addition, the positioning of the safety mechanism, fire selector, magazine release, and bolt hold open may be designed for exclusive use by a right- or left-handed user, which may make it difficult for an opposite-handed user to smoothly use the firearm.

Another disadvantage of known firearms is the inability to fully adapt to the use of different calibers. Specifically, the ejection system may eject the cartridge casing ("case") of one caliber perfectly and another may have a tendency to "stove pipe" or double feed another. Stovepipe is a term describing a case that fails to completely eject and is pinned sticking out of the firearm. A double feed describes a case that is not ejected and remains held by the bolt. As the bolt moves forward to load the chamber with a round, the bolt picks up a second round from the feeding device and attempts to force both the case and the round into the chamber. Additionally, the ejection port may be properly sized for one caliber but too small for another caliber. On the other hand the ejection port may be too large and allow foreign debris to enter and collect in the receiver, which may cause the firearm to fail to function.

An additional disadvantage of known firearms is a tendency to "blow up" when fired after being removed from an immersed state in water. "Blow up" is the term that describes pressures in a chamber and/or barrel exceeding the specified tolerances, causing stress fractures in or fragmentation of the barrel, chamber, and/or parts surrounding the chamber and/or barrel. Such a condition can lead to severe injury and even death to the firearm user.

The ideal firearm could: 1) fire a variety of cartridges of existing and future designs required by varying missions without the substitution of many parts; 2) use existing and future feeding devices (magazines) for those calibers; 3) regardless of caliber, have the same controls for cycling the weapon, fire control, changing feeding devices (magazines), and holding open or releasing the bolt; 4) be able to fire reliably in the semi and fully automatic modes; and 5) be able to operate in any environment.

The problem in creating the ideal firearm described above is that different cartridges have different lengths, shapes, and weights. These differences effect the way cartridges are fed, fired, extracted, and ejected. Each of these elements is critical and must be optimized for reliable operation. Therefore, a design, which may work reliably for one caliber, may not work well at all for another caliber.

To further complicate things, existing feeding devices which hold the ammunition ready to be fed into the chamber, vary by: 1) size, 2) method of restraining the cartridges (e.g., different feed lips), 3) method of attachment to the firearm; 4) features (e.g., some have provisions for a bolt hold open device and some do not).

Accordingly, a need exists for a modular firearm that can fire a wide variety of calibers of ammunition, utilize many types of currently existing magazines and have ambidextrous controls located in the same position in different configurations. A need exists for a firearm that is able to function long periods of time under harsh conditions without needing to be cleaned or serviced. A need also exists for a firearm configuration that is able to fire immediately after being fully immersed in water. In addition a need exists for a firearm to perform a variety functions with improved durability and that may be adapted to the specific circumstances of each operation and conflict.

BRIEF SUMMARY OF THE INVENTION

The present invention has been developed in response to the present state of the art, and in particular, in response to the problems and needs in the art that have not yet been fully solved by currently available firearms. In accordance with the invention as embodied and broadly described herein in the embodiments, an improved firearm is provided. According to one exemplary embodiment, the firearm may take the form of a rifle with a main receiver to which can be attached a variety of barrels, bolts (including the extractor and firing pin), ejectors, and feeding device fixtures (magazine wells) that can reliably fire the desired calibers from existing and future feeding devices.

The design of the breech mechanism (bolt and bolt carrier) and the housing that contains the breech mechanism are designed to accommodate the differences in the calibers and feeding devices. The bolt, bolt carrier, and rails of the receiver that support and guide the movement of the bolt and bolt carrier must have ample clearance to accept the differing feed attachment devices (magazine wells or magazine well inserts), and yet must leave a clear path to the ejection port. The bolt and bolt carrier must be designed to adequately engage the rear of the cartridge to push it into the chamber, yet the bolt and bolt carrier must adequately clear all features of the feeding devices (e.g., a magazine), such as the lips, which restrain the cartridges in a magazine. Some of the feed attachment devices may require feed ramps to help guide the cartridge smoothly in the transition from the feeding device into the chamber (e.g., feed device fixture for an AK47 magazine). Other feed attachment devices may require stops and catches to properly position the magazine and hence the cartridges for proper feed into the chamber (e.g., AK47 and M14 magazines).

There are many types of ejectors used in automatic firearms. The most reliable and efficient ejector must be solid so that when the empty cartridge case hits the ejector, the ejector does not flex or break and the empty case is ejected forcefully and completely from the firearm. To handle the lengths, weights and shapes of the various cartridges, the ejector must be able to be attached at various positions between the back end of the feeding device and the chamber. In some configurations, the position of the ejector may be ahead of the rear end of the feeding device. If the ejector is placed behind the feeding device (e.g., the FN FAL), the cartridge case may not be ejected before the bolt picks up a new cartridge if the bolt is not carried sufficiently to the rear during cycling.

Furthermore, the direction the empty cartridge is ejected is important. The rifle should be able to be shot from either the right or left hand with the cartridge being ejected forward and away from the shooter. Ejection should not be so high as to reveal the shooters position. Directing the ejection of empty cartridge cases of various dimensions may be assisted by a case deflector, which can be positioned at various points in relation to the position of the ejector. Different case deflectors may be necessary for different calibers because the angle of the deflector with respect to the receiver may need to be different as well as its position. Additionally, directing the ejection of an empty cartridge case may also be assisted by positioning the ejector for each type of cartridge in the firearm.

One embodiment of the invention may have the deflector and/or the ejector as part of the feeding device fixture, such as a magazine well. Alternatively, an adjustable ejection port may be used that would act similarly to a deflector, by adjusting the length and width of the ejection port.

Some feeding devices (such as M14, M16, and FAL magazines) have features that operate bolt hold open systems. When the magazine is empty, its follower pushes up a protrusion on the bolt hold open system, which stops the bolt behind the feeding device. The purpose of the bolt hold open system is to keep the bolt open while the operator ejects an empty magazine and inserts a full one. After the full magazine is inserted, the operator can simply depress part of the bolt hold open system and the bolt automatically closes and loads a cartridge into the chamber. Without a bolt hold open system, the operator must eject the old magazine, insert a new one and then manually cycle the action.

Some feeding devices (such as the AK47 and G3 magazines) do not have features that can operate a bolt hold open system. Yet a bolt hold open system even if not automatically operated by the empty magazine, is useful. At times an operator may want to manually engage the bolt hold open system to load or inspect it.

The firearm may have an ambidextrous magazine release that is roughly the same place and which is operated in the same way regardless of the caliber or feeding device used. The ideal solution may also have a bolt hold open system, which works with all types of feeding devices (though manually with some) and which is located in the same position regardless of caliber or feeding device used.

The way that the invention works to solve the problem is described below: the bolt moves back and forth within the bolt carrier. As the bolt moves back and forth within the carrier, it can rotate at a fixed point on the bolt, which is near the front of the bolt. Because the point of rotation is closer to the front of the bolt than to the rear, the front of the bolt does not rotate much but is held in a certain position with respect to the feeding device and chamber. The rear of the bolt may rotate further so that it can lock into engagement with a locking surface.

Because the front of the bolt is constrained by the bolt carrier rather than something adjacent to it (as is the case with the FAL and SKS rifles), there is more room to accommodate a wide variety of feed attachment devices and corresponding feeding devices. Additionally, all calibers can use the same bolt carrier. The bolts for all calibers begin as the same casting or forging and are machined slightly differently to fit the head of the appropriate caliber and accept the correct extractor.

The magazine release buttons are the positioned in the same location on the firearm regardless of which caliber or feeding device is used. If the magazine release button is depressed from either side of the receiver, the feeding device (e.g., s magazine) may be removed from the firearm. The feeding device fixtures are different depending on feeding device used.

For example, the fixture for the AK47 magazine works as follows: As the button on either the right or left side is depressed, rounded portions of the button engage angled portions of the slide, drawing the slide toward the rear and compressing the slide's springs. The slide's tip is pulled from under the tab on the back of the AK47 magazine and the magazine is released. The mechanism works very much the same for M14 and FN FAL magazines but the parts used are different.

The M16 magazine release is different. M16 magazines are held in place by an arm with a tab, which engages a slot on the side of the magazine. The M16 magazine release of the invention is also ambidextrous. The magazine release button on the right side of the receiver is directly connected with the magazine release arm on the left side of the receiver. When the right magazine release button is depressed the magazine release arm is pushed out to the left releasing the magazine. When the left magazine release button is depressed, the magazine release arm is drawn via a cam to the left also, thereby releasing the magazine.

The firearm according to the invention is generally more ergonomic than other automatic firearms. With firearms made for the military and police, it is very important that the operator can manipulate all controls while holding the rifle by the pistol grip with his strong hand and while looking at the intended target through the sights. The strong hand is the right hand if the person is right handed; or the left hand if the person is left handed.

While holding the rifle by the pistol grip with the strong hand, the operator can manually cycle the firearm by drawing the charging handle to the rear with his other hand and then releasing it. The fire control selector which allows the operator to choose between the fire control positions of safe, semi-automatic, and fully automatic can be easily manipulated with the thumb of the strong hand. The charging handle is positioned such that the charging handle can be actuated with one hand while the bolt hold open device is actuated with the tip of the index finger of the other hand that is holding the grip of the firearm.

If the firearm is empty, the operator can use the index finger of his strong hand to push the magazine release button, which will drop the empty magazine. This may be done simultaneously while grabbing a loaded magazine with the operator's other hand and then inserting the magazine into the magazine well. If the magazine is of the type that has features that automatically operate the bolt-hold-open-device, the bolt can be closed and a round loaded into the chamber by simply depressing the bolt-hold-open-device with either the index finger of the strong hand or by the thumb of the other hand immediately after the loaded magazine is inserted.

These and other features of the present invention will become more fully apparent from the following description, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 5*aa* is a cross-section view of a pin and detent securing a deflector to the receiver;

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 9, is not intended to limit the scope of the invention, as claimed, but is merely representative of presently preferred embodiments of the invention.

The present invention utilizes a number of physical principles to enhance the motion of parts in a firearm. For example, a beveled surface or angled slot is used to convert force from one direction into a resulting force in another. The manner in which the present invention utilizes these principles to provide a modular ambidextrously controlled firearm will be shown and described in greater detail with reference to FIGS. 1 through 8.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together.

Figure 1:
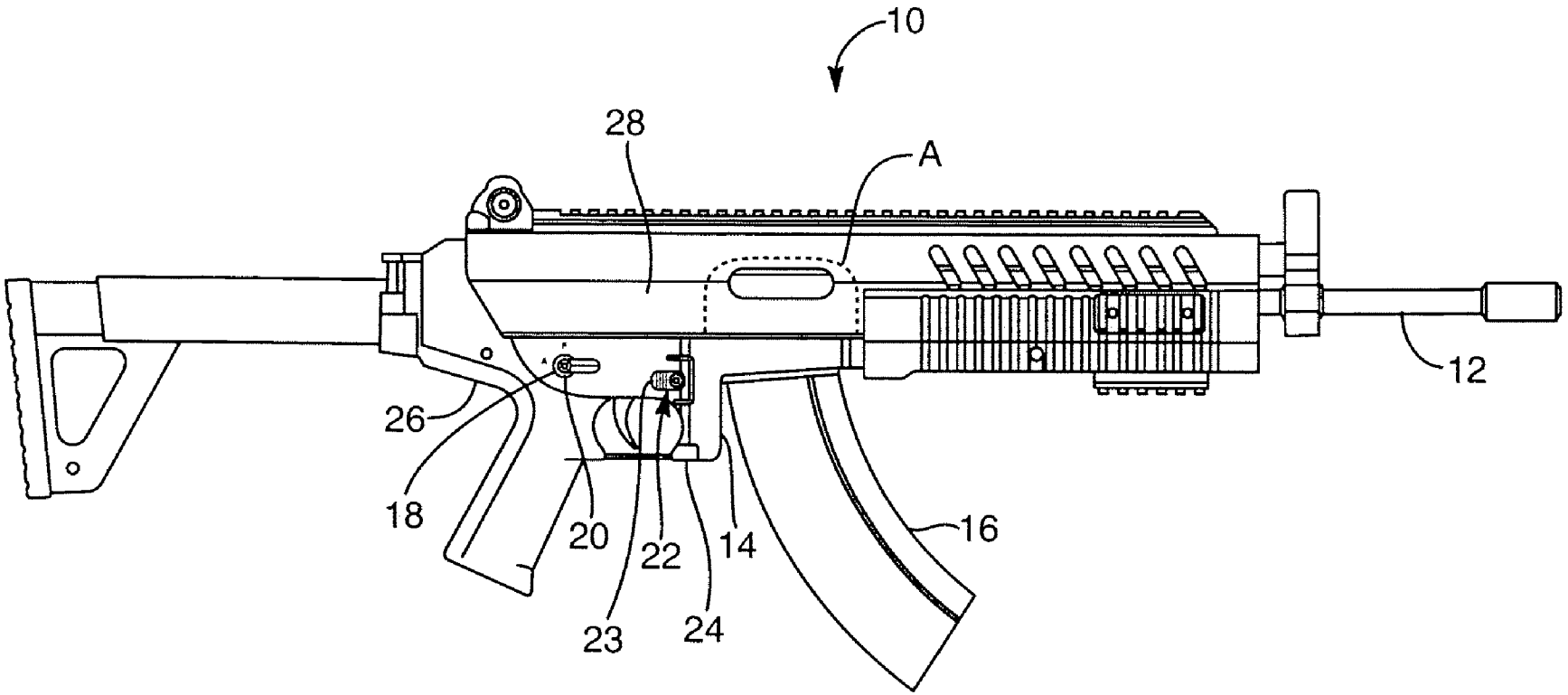
FIG. 1 is a side elevation view illustrating an embodiment of a firearm according to the invention.
Figure 2A:
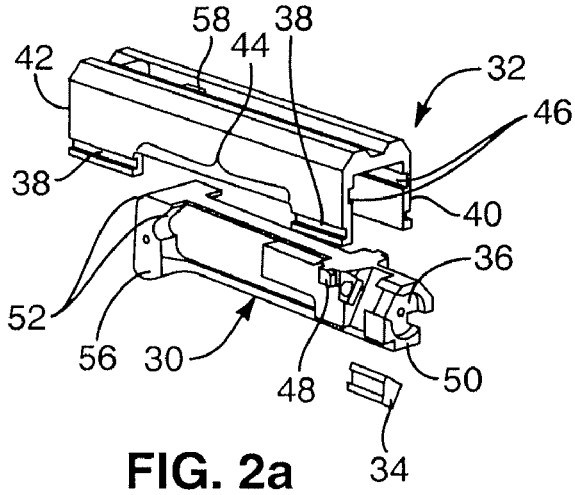
FIGS. 2*a*, 2*b*, 2*c*, and 2*d* illustrate a bolt, bolt carrier, and extractor of the firearm of FIG. 1 in three perspective views and an elevated front view showing the bolt face 36, respectively.
Figure 2B:
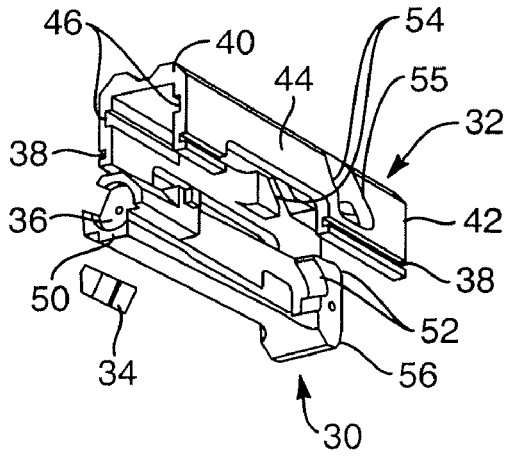
Figure 2C:
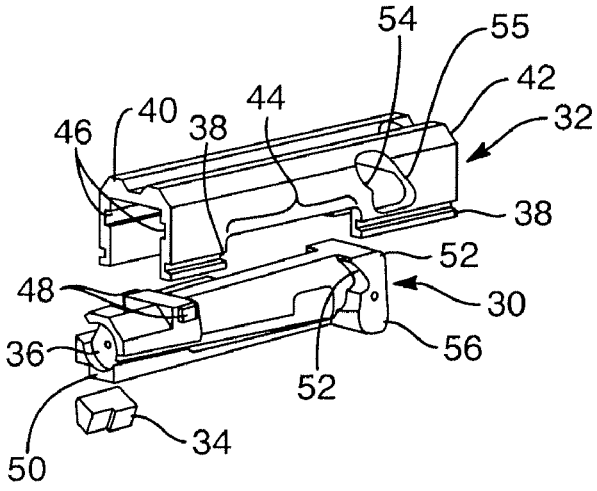
Figure 2D:
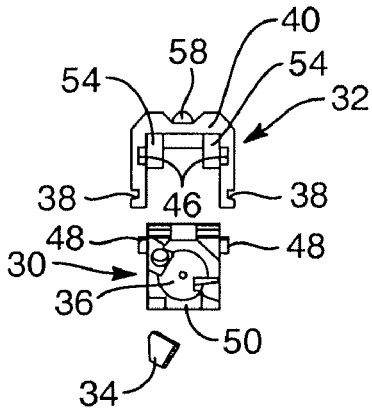

Referring to FIG. 1, a side elevation view illustrates a firearm 10 according to the invention that can, by the substitution of a barrel 12, bolt (shown in FIG. 2), and feed attachment device 14 be adapted to fulfill a variety of functions using future and existing calibers and their associated feeding devices 16. In this configuration, the feeding device 16 is a magazine well. In addition, the fire selector 18, safety 20, magazine release 22, and bolt hold open control surface 24 may be ambidextrously controlled and disposed in the same position on the firearm 10 regardless of caliber or configuration. As shown the fire selector 18 and safety 20 are integrally formed and positioned in the lower receiver 26. The feed attachment device 14 is attached to the lower receiver 26, and the lower receiver 26 is attached to the receiver 28. Area A will be described in detail in FIGS. 5, 5*a*, and 5*b*.

As shown, the magazine release 22 is disposed above a front portion of a trigger guard 29 on a side of the firearm. In this configuration, the magazine release 22 includes a first button 23 (as shown) that is accessible from this side of a firearm. In addition, the magazine release 22 includes a second button (not shown) that is accessible on the opposite side of the firearm. The bolt hold open control 24 extends along both sides of the front portion of the trigger guard 29 and therefore, may accessed on both sides of the firearm 10. This positioning allows a user to easily actuate the magazine release 22 and the bolt hold open control 24 with a trigger finger of the user regardless of whether the user is right or left handed.

Referring to FIGS. 2*a*, 2*b*, 2*c*, and 2*d*, a bolt 30, bolt carrier 32, and extractor 34 of the firearm of FIG. 1 are illustrated in three perspective views and an elevated front view showing the bolt face 36, respectively. In order for the firearm to perform a variety of functions, the invention utilizes a number of improved systems. The first improved system is found in the bolt 30 and bolt carrier 32. The bolt carrier 32 is shaped to enclose the bolt 30 on three sides. The bolt carrier 32 is open at the back 42 so that the total length of the bolt 30 is minimized and the length of travel optimized. Length of travel is the movement of the bolt 30 relative to the bolt carrier 32. Length of travel is important as it affects the recoil properties of the firearm. Typically, a greater length of travel yields a slower cyclical rate of fire. In addition, in an adjustable operating system where gas may be vented to reduce pressure in a gas system, it may be easier to determine how much gas to vent when the length of travel is longer.

Additionally, the bolt carrier 32 comprises two aligned grooves 38 positioned proximate the front 40 and the back 42 on each side of the bolt carrier 32. The grooves 38 engage and ride upon rails in the receiver 28 (shown in FIG. 1). Each groove 38 is long enough to support the bolt carrier 32 but short enough to minimize contact between the bolt carrier 32 and the rails of the receiver 28 (shown in FIG. 1). Between the two grooves 38 on each side is a large gap 44 that allows debris, worked loose by the movement of the bolt carrier 32, to fall away from the rail and grooves 38 of the bolt carrier 32. The coupled grooves 38 allow the bolt carrier 32 to function with foreign matter in the receiver 28 (shown in FIG. 1), such as sand and dirt. The minimum contact surface lessens the chance of foreign material being caught between the grooves 38 and the rails causing the bolt carrier 32 to become stuck within the receiver 28 (shown in FIG. 1).

Another feature of the bolt carrier 32 comprises a second set of grooves 46 within the bolt carrier 32 that the bolt 30 engages and rides on. This second set of grooves 46 are positioned proximate the front 40 of the bolt carrier 32. The bolt 30 comprises bolt guide ears 48 that ride within the second set of grooves 46 in the bolt carrier. The bolt guide ears 48 and the second set of grooves 46 help position the catch lip 50 of the bolt face 36 to pick up a new cartridge from the feeding device and move the cartridge into the chamber (shown in FIG. 3) of the firearm.

The bolt guide ears 48 and the second set of grooves 46 also help to properly position the bolt face 36 to close the chamber (shown in FIG. 3) in preparation of firing the cartridge. The bolt 30 is securely fixed against the face of the chamber (shown in FIG. 3) when the back end of the bolt 30 drops and locks against a locking surface 90 (shown in FIG. 4) within the receiver 28 (shown in FIG. 1). This motion is guided by cam surfaces 52 on the bolt 30 and reciprocal cam surfaces 54 on the bolt carrier 32. The reciprocal cam surfaces 54 may be formed in the bolt carrier 32 through the window 55. In other words, in forming the window 55 on a side of the bolt carrier 32, the reciprocal cam surfaces 54 on both sides of the bolt carrier 32 may also be formed. The window 55 and the reciprocal cam surfaces 54 may be formed through machining, casting, stamping, forging, or any other method known in the art.

The cam surfaces 52 and the reciprocal cam surfaces 54 act to guide the bolt into and out of proper position of the bolt locking surface 56 against locking surface of the receiver 28 (shown in FIG. 1). The surfaces 52 and the reciprocal cam surfaces 54 may be formed at any angle.

Also shown is a piston engagement surface 58 on top of the bolt carrier 32. The piston engagement surface 58 is struck by a piston (not shown) to push the bolt 30 and bolt carrier 32 away from a barrel 12 of the firearm 10.

It should also be noted that the guide ears 48 on the bolt in conjunction with the second set of grooves 46 allows the receiver 28 (shown in FIG. 1) to be designed such that the area between the bolt 30 and the feeding device is unobstructed by parts, such as the bolt carrier 32, etc. A wide variety of feed attachment devices allows the firearm to properly position the wide variety of known and existing feeding devices, such as magazines or belted ammunition, for trouble-free feeding of ammunition into the firearm. For instance, an M16 type magazine, an AK-74 magazine (converted to handle 5.56 NATO), or a belt of ammunition may be used in the same gun by merely changing the feed attachment device. A feed attachment device may be a magazine well or belt feed device.

Figure 3:
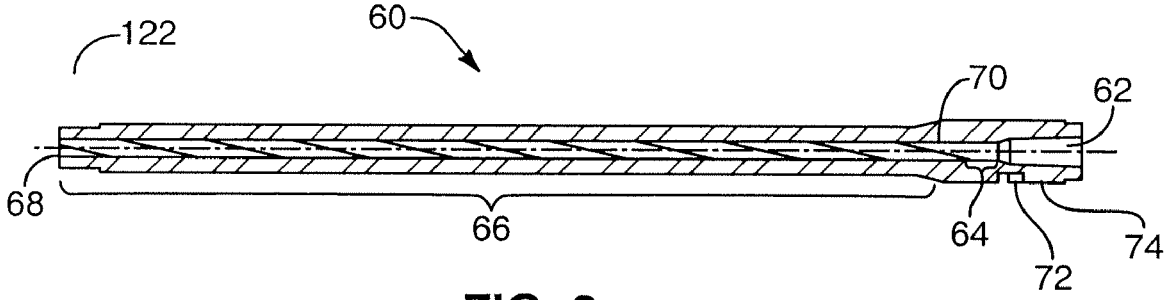
FIG. 3 is a side elevation section view illustrating the systems of the barrel of the invention shown in FIG. 1.

Referring to FIG. 3, a side elevation section view illustrates the improved systems of the barrel 60. The barrel 60 comprises a chamber 62, an extended area of free bore 64, the rifling 66, and the muzzle 68. The area of free bore 64 immediately following the chamber 62 that is tapered, not rifled, and is larger than the outer diameter of a bullet designed for the barrel 60. The rifling 66 begins after the area of free bore 64 continues to the muzzle 68 of the barrel 60.

The area of free bore 64 is tapered to allow the expanded gases of the firing cartridge to pass around and in front of the bullet. These expanding gases force any collected water out of the barrel 60, in front of the bullet.

Alternatively, the free bore 64 is kept short and deep grooves 70 are cut in the barrel 60 proximate the chamber 62. The depth of the grooves moves to a normal depth after an inch or two of deep groove depth. The deep grooves allow the gases to pass in front of the bullet to push water out of the barrel. By combining or using individually the elements of an extended free bore 64 and the deep grooves 70 of the rifling 66, the barrel 60 may be safely fired after being fully immersed in water without draining the barrel. The purpose of these changes to the barrel 60 is to prevent blowing up the firearm, which may kill or severely injure the user.

Another feature of the barrel 60 is an angled slot 72 cut proximate the chamber 62 in the outer wall of the barrel 60. The angle slot 72 is mated with a head space adjustment device that sits in a barrel trunion 86 (shown in FIG. 4) of the receiver 28 (shown in FIG. 1). As the head space adjustment device (shown in FIG. 3*b*) is moved from one side of the barrel trunion 86 (shown in FIG. 4) to the other, the barrel is moved forward and backward within the receiver. This allows for the proper head spacing of each barrel attached to the firearm. Head spacing is important because improper head spacing of a firearm can damage the firearm or injure or kill the user when the firearm is fired. Also note that the life of the barrel may be extended by nitriding or boron nitriding the bore of the barrel.

Figure 3A:
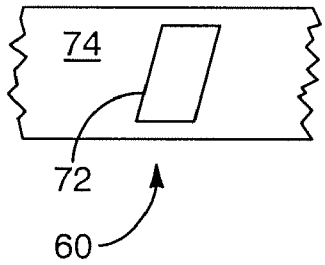
FIG. 3*a* is a bottom view of the barrel of FIG. 3 illustrating the angled slot.

FIG. 3*a* is a bottom view of the barrel 60, particularly the angled slot 72 cut into the outer wall 74. Movement of the headspace adjustment device (shown in FIG. 3*b*) with respect to the angled slot forces the barrel 60 to move in and out of the receiver 28 (shown in FIG. 1). It should be noted that the barrel 60 may be changed by moving the headspace adjustment device (shown in FIG. 3*b*) to one side such that the angled slot 72 no longer engages the headspace adjustment device. The barrel 60 may then be easily removed from the barrel trunion (shown in FIG. 4). Also, the headspace adjustment device (shown in FIG. 3*b*) is only able to move laterally within the barrel trunion. Therefore, movement of the headspace adjustment device (not shown) with respect to the angled slot forces the barrel to move in and out of the receiver 28.

Figure 3B:
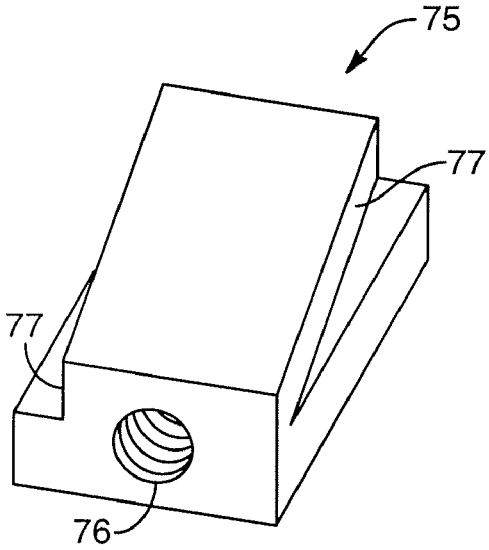
FIG. 3*b* is a perspective view of a head space adjustment device.

Referring to FIG. 3*b*, a perspective view illustrates a headspace adjustment device 75. The headspace adjustment device 75 comprises an adjustment hole 76 and two parallel beveled surfaces 77. The interior of the adjustment hole is threaded so that as an adjustment pin (not shown) can be turned therein, the headspace adjustment device 75 moves back and forth within the barrel trunion (shown in FIGS. 4 and 4*a*) to secure the barrel 60 within the firearm and to move the barrel 60 to adjust the head spacing of the firearm. The two parallel beveled surfaces 77 slide within the slot 72 in the barrel 60 to move the barrel 60 in and out of the receiver.

Figure 4:
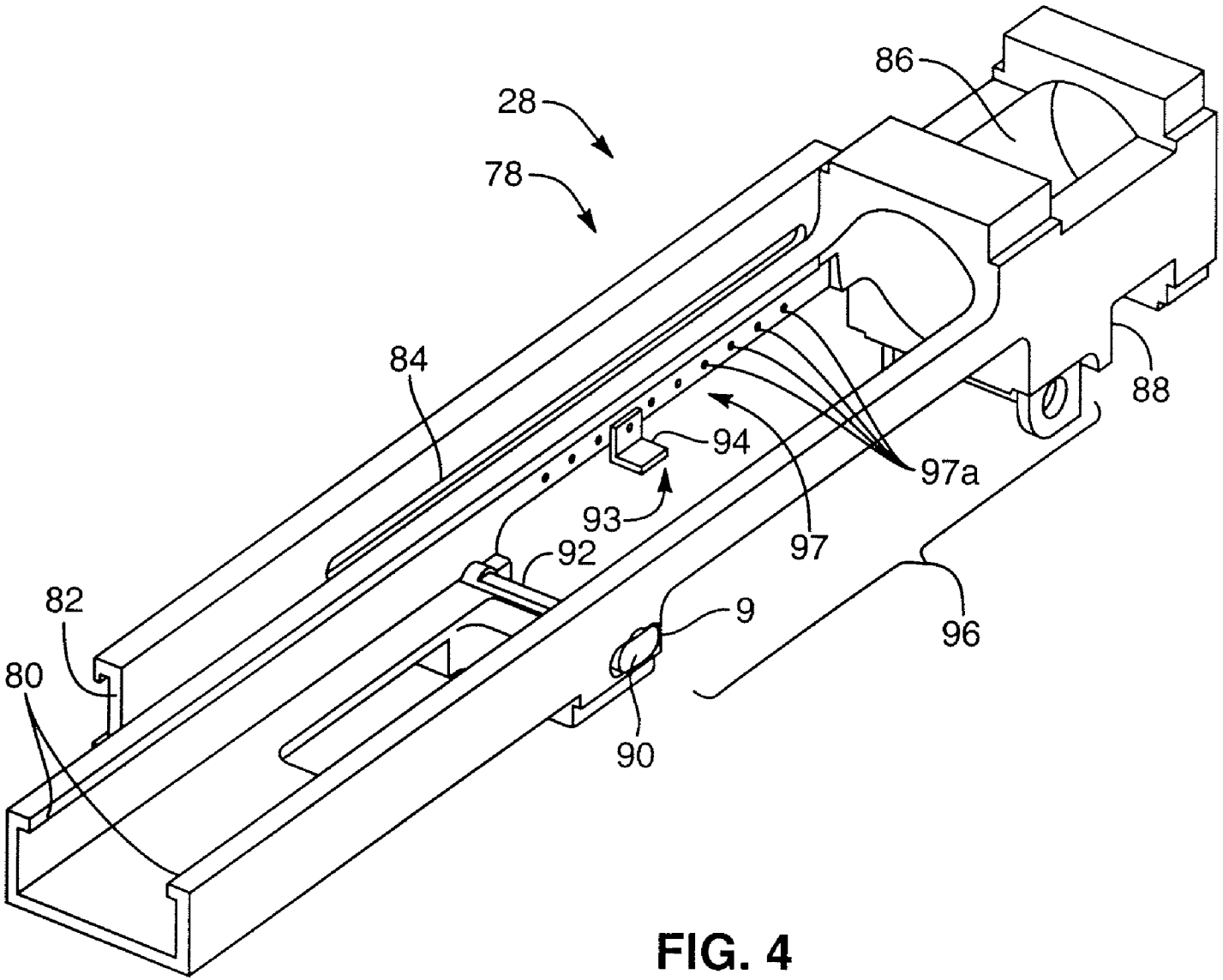
FIG. 4 is a perspective view illustrating the receiver of the firearm of FIG. 1.

Referring to FIG. 4, a perspective view illustrates a portion 78 of the receiver 28 of the firearm 10 of FIG. 1. As shown, the receiver 28 comprises rails 80 which are engaged by the grooves of the bolt carrier. The receiver 28 also comprises a cocking handle slide 82 and cocking handle slot 84. In addition, the receiver 28 comprises a barrel trunion 86 and a barrel attachment slot 88. Also shown is a locking pin 90, which comprises the locking surface 92 against which the bolt is set when the chamber 62 (shown in FIG. 3) is closed.

The invention also includes the ejection system 93 that removes a fired cartridge from the receiver 28 and the firearm 10 (shown in FIG. 1). In this configuration, the ejector 94 is positioned forward of a rear end 95 near the middle of a feed device attachment point 96 positioning to prevent double feeding, because the case must be knocked away from the bolt face 36 (shown in FIGS. 2*a* through 2*d*), before the bolt is able to pick up another round from an attached feeding device. The ejector 94 is attachable to the receiver 28 and can be placed at different attachment positions 97, such as toward the rear end 95, the middle, or the front end of the feed device attachment point 96 located between the barrel trunion 86 and the locking shoulder 92. The invention provides for at least two different attachment positions 97 for the ejector 94. The ejector 94 may also be attached to a feed attachment device (not shown). The attachment positions 97 may be defined by feature in the receiver 28. In this embodiment, the attachment positions 97 are defined by a series of evenly spaced holes 97*a* in a wall of the receiver 28 for adjusting the position of the ejector 94. The ejector 94 may comprise a pin, screw or rivet that is pushed through the hole in the receiver 28 that corresponds to the desired position of the ejector 94 within the receiver 28. Additional pins may be used to more fixedly attach the ejector 94 to the receiver 28. The holes 97*a* may be square or some other shape to prevent rotation or movement of the ejector 94 with respect to the receiver. The ejector 94 may also be bolted to the receiver 28. Of course, any of the pins or screws discussed above may be integrally formed with the ejector 94. Alternatively, the ejector 94 may be integrally formed with a feed attachment device or attached to the feed attachment device by welding, riveting, or pinning the ejector in place.

Figure 4A:
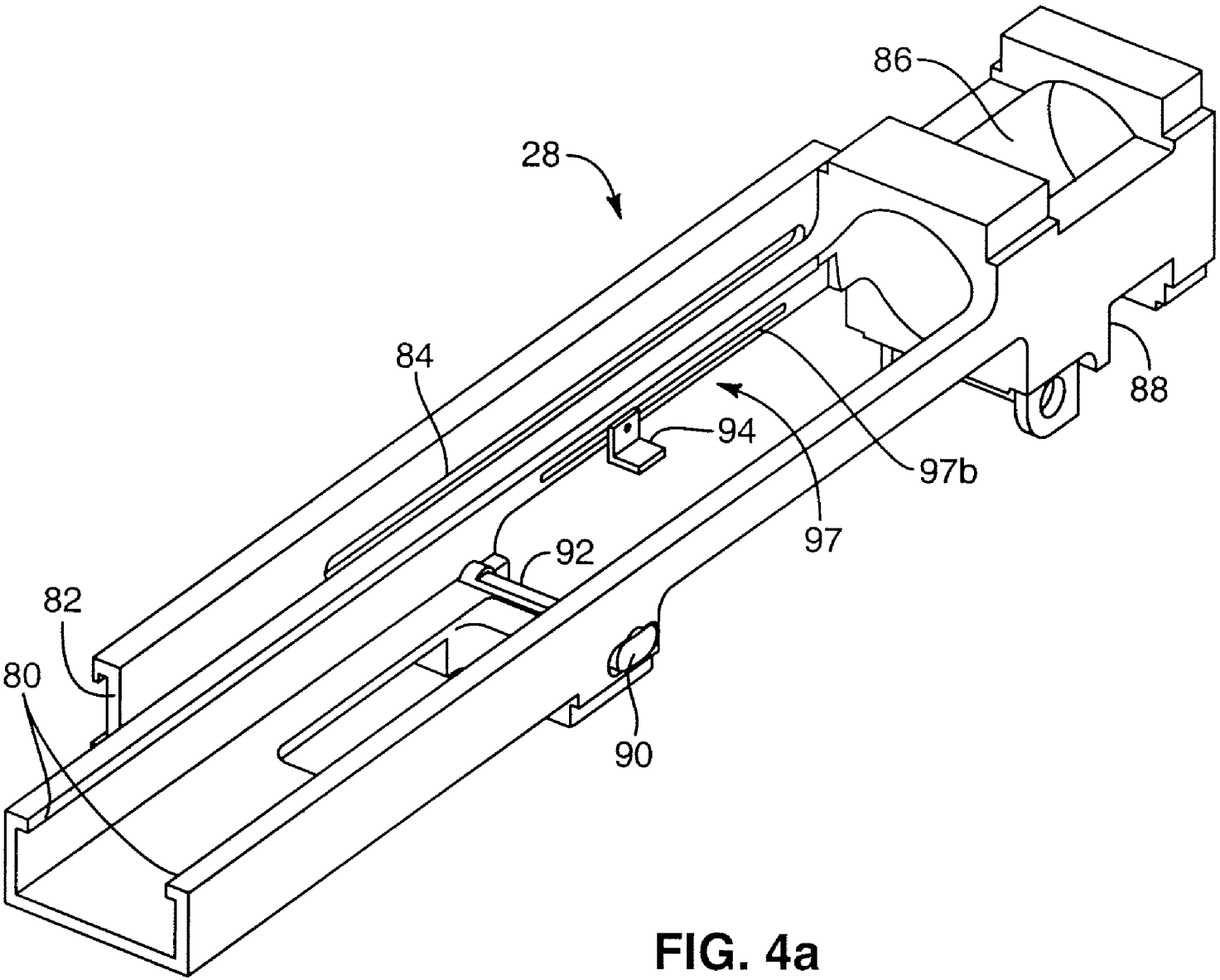
FIG. 4*a* is a perspective view illustrating an alternative variation of the receiver of FIG. 4.

Referring to FIG. 4*a*, a perspective view illustrates an alternative configuration of the receiver 28. In this configuration, the attachment positions 97 are defined by an elongated slot 97*b*. The ejector 94 is attachable along the slot's 97*b* length, which provides a plurality of attachment positions 97. The ejector 94 may be bolted, clamped, pinned into a desired position along the length of the slot 97*b*.

Figure 5:
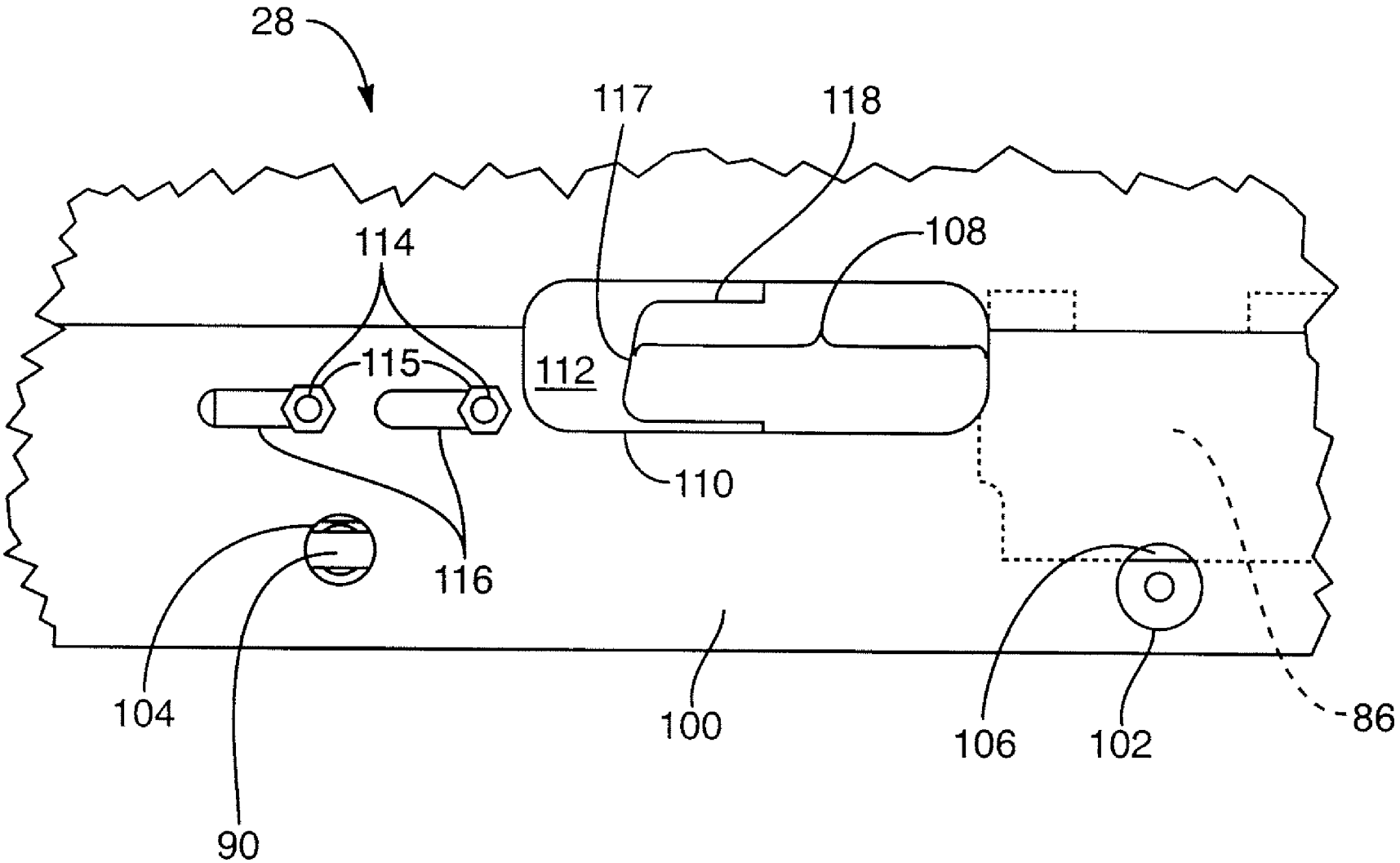
FIG. 5 is an elevated side view of area A of FIG. 1 of the receiver.

Referring to FIG. 5, an enlarged cut away elevation view of area A shown in FIG. 1 illustrates an outside portion 100 of the receiver 28. As shown, the outside portion 100 comprises a first access hole 102 and a second access hole 104. The first access hole 102 provides access to the barrel adjustment device 106, which allows the head spacing to be adjusted. The second access hole 104 provides access to the locking pin 90 discussed above in reference to FIGS. 4 and 4*a*.

The receiver 28 includes an adjustable ejection system, which includes an adjustable ejection port 108. The ejection port 108 is defined by an aperture 110 formed in a wall of the receiver 28 that begins at a position proximate the barrel trunion 86 (outlined in phantom lines) and extends rearward. The length and width of the aperture 110 is determined by the largest caliber of ammunition to be used with the firearm. The ejection port 108 is further defined by a deflector 112 that covers part of the aperture 110 to adjust the size of the ejection port 108. Once the deflector 112 is properly positioned at one of several attachment positions to allow a caliber of ammunition to properly eject and protect the receiver against foreign matter from unnecessarily getting in the receiver, two pins 114 coupled with nuts 115 to secure the deflector 112 against the receiver 28. In this embodiment, the deflector 112 is attached to the receiver 28 by the two pins 114 disposed in attachment slots 116. In addition, the deflector 112 may be made of metal, plastic, composite or other suitable material.

The adjustable ejection port 108 has the added advantage of being able to better control the ejection of a case. As the case is knocked from the bolt face 36 (shown in FIGS. 2*a* through 2*d*) by an ejector 94 (shown in FIGS. 4 and 4*a*), the case may not be deflected fully out of the receiver 28 of the firearm and the case may stove pipe. To prevent this problem, the back of the ejection port 117 may be positioned to deflect the case out of the firearm and to generally move in a direction desired by the user. Also, the deflector 112 may include a buffer 118, which acts to deflect the shell downward as it exits the firearm. The buffer 118 may be material that has been bent back to form a thicker surface than the ordinary thickness of the material used in the deflector 112. In addition, an adjustable ejection port is one more aspect of the firearm that the user to may adapt to a case of a specific caliber. For instance, a 50 BMG case will not eject through an ejection port 108 set for the ejection of 5.56 cases.

Figure 5A:
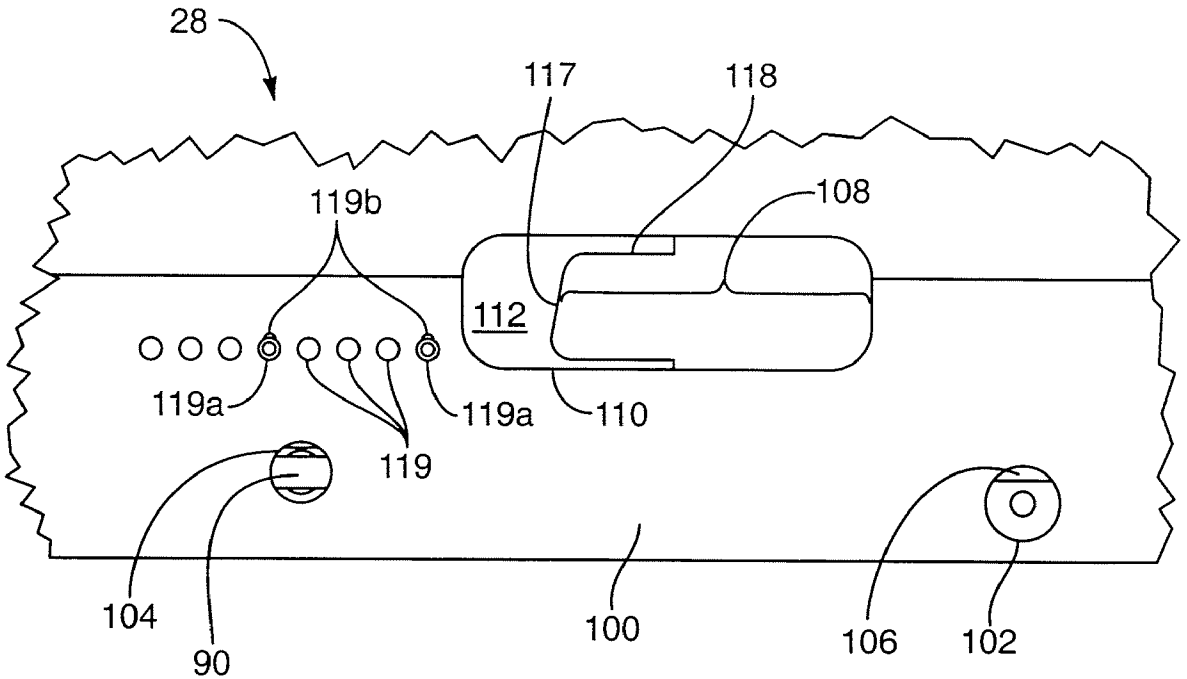
FIG. 5*a* is an elevated side view of an alternative configuration of area A of the receiver shown in FIG. 1.
Figure 5A:
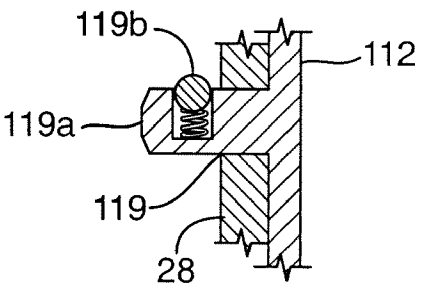

Referring to FIG. 5*a*, an enlarged cut away elevation view of area A shown in FIG. 1 illustrates an alternative configuration for attaching the deflector 112 to the receiver 28 at one of at least two attachment positions. The attachment positions are defined by several holes 119. In this embodiment, the deflector is attached to the receiver 28 by two pins 119*a*. Each pin 119*a* comprises a detent 119*b* as illustrated in FIG. 5*aa*. As shown, the detent 119*b* is a ball and spring press fit into a hole in the pin 119*a*. Alternatively, the detent may be material extending from a surface of the pin. Additionally, the deflector 112 may include threaded holes (not shown) and thus may be secured to the receiver by using threaded pins and bolts extending through the holes 119 in the receiver 28.

FIG. 5*aa* illustrates how the detents 119*b* secure the deflector 112 to the receiver 28 through holes 119. As shown, the pins 119*a* are integrally formed with the deflector 112.

Figure 5B:
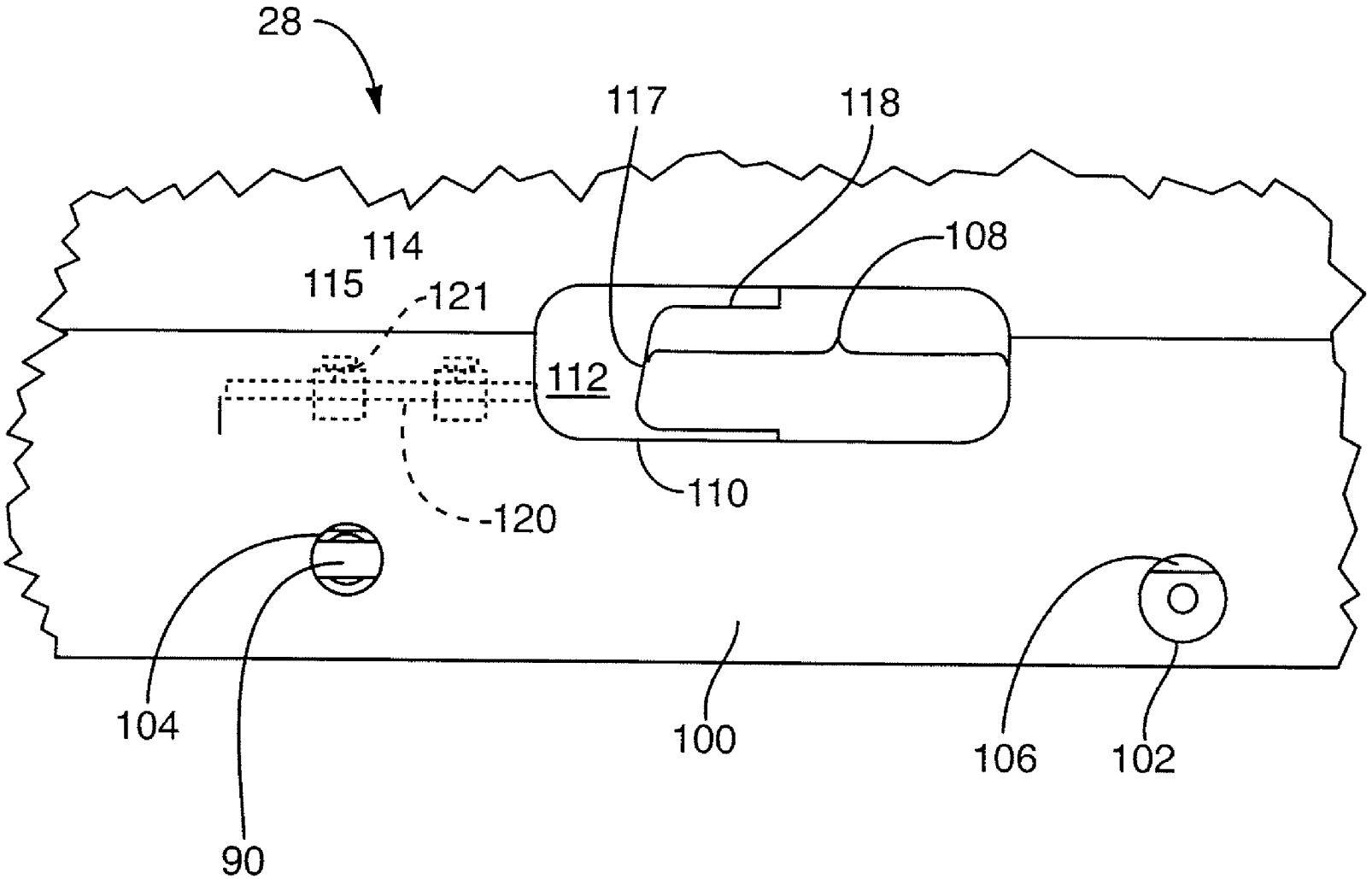
FIG. 5*b* is an elevated side view of another alternative configuration of area A of the receiver shown in FIG. 1.

Referring to FIG. 5*b*, an enlarged cut away elevation view of area A shown in FIG. 1 illustrates another alternative configuration for the deflector 112 attachable on the receiver 28 at one of at least two attachment positions. In this configuration, the deflector 112 is attached to the firearm by a rail 120 and clamps 121. The rail 120 provides a plurality of attachment positions along the rail 120 to which clamps 121 can be used to secure the deflector 112 to the rail 120. Of course, the deflector 112 may be secured to the outside of the receiver 28 as well as the inside of the receiver 28 as shown in FIGS. 5, 5*a*, and 5*b*.

Figure 6:
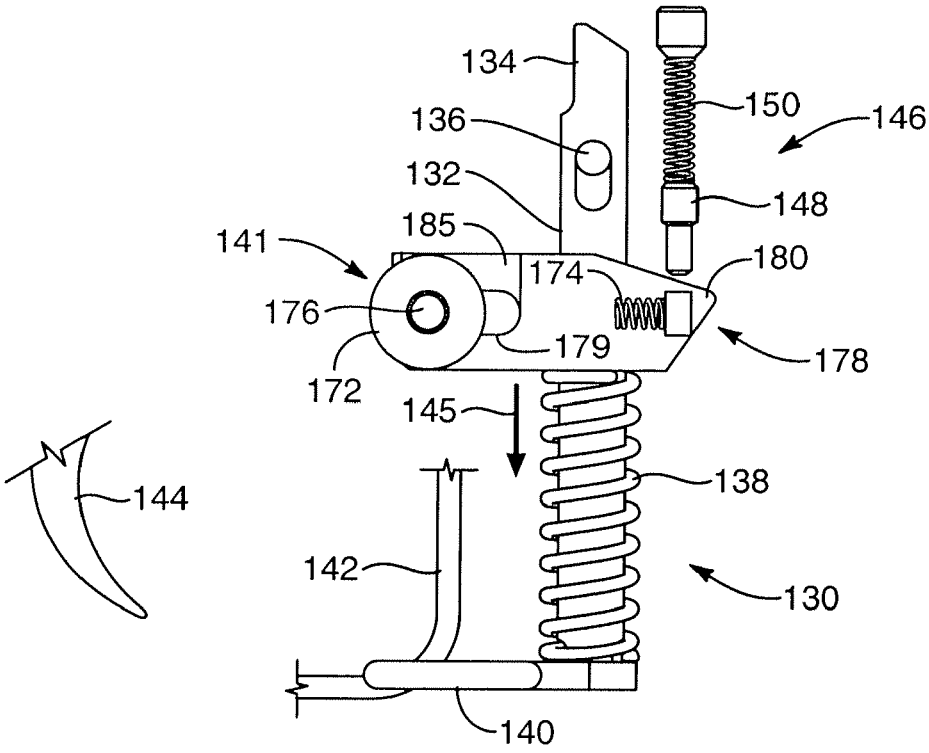
FIG. 6 is an elevated side view of the bolt hold open system and the magazine catch system.

FIG. 6 features the ambidextrous access and convenient positioning of a bolt hold open system 130 and a magazine catch system 141. The bolt hold open system 130 comprises a bolt hold open body 132 having a bolt catch surface 134, a bias pin 136, a biasing spring 138, and a bolt hold open control arm 140. In this embodiment, the bolt hold open body 132 extends up through the magazine catch system 141 with the bolt catch surface 134 positioned to catch a bolt 30 (shown in FIGS. 2*a* through 2*d*) before the bolt 30 is allowed to close a chamber (shown in FIG. 3). A bias pin 136 is pressed into a hole in the bolt hold open body 132 above the magazine catch system 141 to prevent the bolt hold open body 132 from being pulled from a firearm.

A biasing spring 138 is positioned over the bottom of the bolt hold open body 132 to bias the bolt hold open body 132 downward as shown by the direction arrow 145 in the firearm. The biasing spring 138 extends between the magazine catch system 141 and the bolt hold open control arm 140, which is attached to the bottom of the bolt hold open body 132.

As shown, the bolt hold open system 130 and the magazine catch system 141 are isolated from the rest of a firearm except for a partially shown trigger guard 142 and a partially shown trigger 144. The trigger guard 142 and the trigger 144 provide perspective on the relative location of the bolt hold open system 130 and the magazine catch system 141 when located within the firearm. In this configuration, the bolt hold open control arm 140 is disposed adjacent the trigger guard 142 (partially shown). More specifically, the bolt hold open control arm 140 extends from in front of the trigger guard 142 (partially shown) toward the trigger 144 (partially shown) horizontally along both sides of the trigger guard 142. The bolt hold open system 130 may be released by urging the bolt hold open control arm 140 downward as shown by the direction arrow 145. This action moves the bolt hold open body 132 down out of the way of the bolt face 36 (shown in FIG. 2*a* through 2*d*). Thus, allowing the bolt face 36 to move past the bolt hold open system 130.

Having the bolt hold open control arm 140 adjacent the trigger guard and accessible on both sides of the firearm (not shown) allows the user to release the bolt 30 (shown in FIG. 2*a* through 2*d*) using their trigger finger or their other hand. It gives the user the ability to actuate the bolt hold open system 130 using either hand without regard to whether the user is right- or left-handed. In this configuration, the bolt hold open control arm 140 extends on both side of the trigger guard 142. Also, the bolt hold open control arm 140 may be integrally formed with the bolt hold open body 132.

The bolt hold open system 130 may be manually operated and may be used with any configuration of the invention or feed attachment device. To hold the bolt open, the bolt face 36 (shown in FIG. 2*a* through 2*d*) is urged toward the trigger 144 and the bolt hold open control arm 140 is urged upward (opposite the direction arrow 145). The bolt face 36 is then allowed to move until the bolt face 36 contacts the bolt catch surface 134. Of course, the bolt hold open system 130 may operate automatically in conjunction with a magazine (not shown) as known in the art.

A magazine positioning device 146 is also shown that helps position a magazine within a magazine well (not shown). The magazine positioning device 146 comprises a positioning pin 148 and a positioning spring 150. The positioning pin 148 is positioned above a part of a magazine (not shown) held in a magazine well (not shown). As the magazine is loaded in the firearm, the positioning pin 148 is displaced, which compresses the positioning spring 150. While the magazine (not shown) is held in the magazine well (not shown), the magazine positioning device 146 urges the magazine against the catch surface 180 of the magazine catch system 141. When the magazine catch system 141 is actuated, the catch surface 180 is moved toward the trigger 144 and disengages from the magazine (not shown). The positioning spring 150 then pushes the positioning pin 148, which in turn urges the magazine from the magazine well (not shown).

Figure 7:
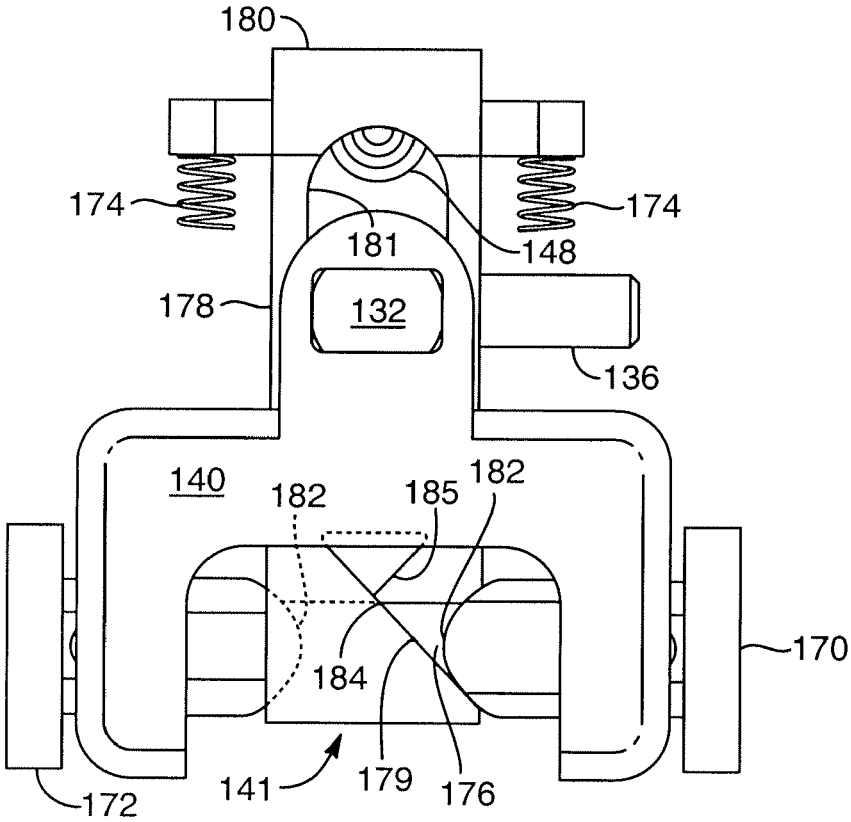
FIG. 7 is a bottom view of a magazine catch system and bolt hold open system shown in FIG. 6.

Also shown in FIG. 6, are some of the components of the magazine catch system 141, which will be more fully described in FIG. 7. As shown in this side elevation view of FIG. 6, the magazine catch system 141 includes a second button 172 attached to a catch guide pin 176 and a catch arm 178 extending from the second button 172 past the bolt hold open body 132 to the catch surface 180. The catch arm 178 includes a slot 179 through which the catch guide pin 176 extends to the opposite side of the catch arm 178. The catch arm also is shown including a second beveled surface 185.

As shown, the bolt hold open system 130 and the magazine catch system 141 are integrated to support the other systems functionality. Specifically, the bolt hold open body 132 extends through the catch arm 178 to help position the catch arm. By integrating the two systems, the systems take up less space and may weigh less than nonintegrated systems. Furthermore, the integrated magazine catch and bolt hold system facilitates the placement of the bolt hold open system 130 and the magazine catch system 141 within a removable magazine well.

Referring to FIG. 7, a bottom view further illustrates the bolt hold open system 130 and the magazine catch system 141 of FIG. 6. The magazine catch system comprises a first button 170 and the second button 172 positioned opposite each other on a catch guide pin 176. A catch arm 178 extends from the first and second buttons 170 and 172 past the bolt hold open body 132 to the catch surface 180.

As shown, the first and second buttons 170 and 172 each include an actuation surface 182. The first and second buttons 170 and 172 may be, rigidly or slidably attached to the catch guide pin 176. The actuation surface 182 may be rounded, curved, angled, or beveled.

The back of the catch arm 178 comprises an elongated slot 179 through which the catch guide pin 176 extends. The surfaces below and above the elongated slot 179 are a first and the second beveled surfaces 184 and 185. In this configuration, the first and second beveled surfaces 184 and 185 extend 45 degrees from the substantially linear motion of the first and second buttons 170 and 172. The actuation surfaces 182 of the first and second button 170 and 172 engage a respective first and second beveled surface 184 and 185. When the first and/or second button 170 and/or 172 is depressed by a user, the actuation surface 182 urges the first beveled surface 184 and/or the second beveled surface 185 and the catch arm 178 to move toward the trigger 144 (shown in FIG. 6). Thus, causing the catch surface 180 to move out of engagement with a magazine (not shown). The catch arm 178 is biased away from the trigger 144 (shown in FIG. 6) to retain a magazine by two catch biasing springs 174.

As shown, the bolt hold open body 132 extends through a slot 181 in the catch arm 178 to limit the motion of the catch arm 178. Also shown, the positioning pin 148 may be seen partially through the slot 181.

In this configuration, either the first and second buttons 170 and 172 may be urged toward the catch arm. When either the first and second buttons 170 and 172 are urged toward the catch arm 178, the actuation surface 182 engages the beveled surface 184 to move the catch arm 178. If the first and second buttons 170 and 172 are slidably attached, both the first and second buttons 170 and 172 may be urged toward the catch arm 178.

The bolt hold open control arm 140 has a U shape. The arms of the U shape are shown in FIG. 6 as extending along both sides of the trigger guard 142. In other words, the bolt hold open control arm 140 wraps around the trigger guard 142 to provide access to the bolt hold control system 130 on both sides of the firearm.

Figure 8:
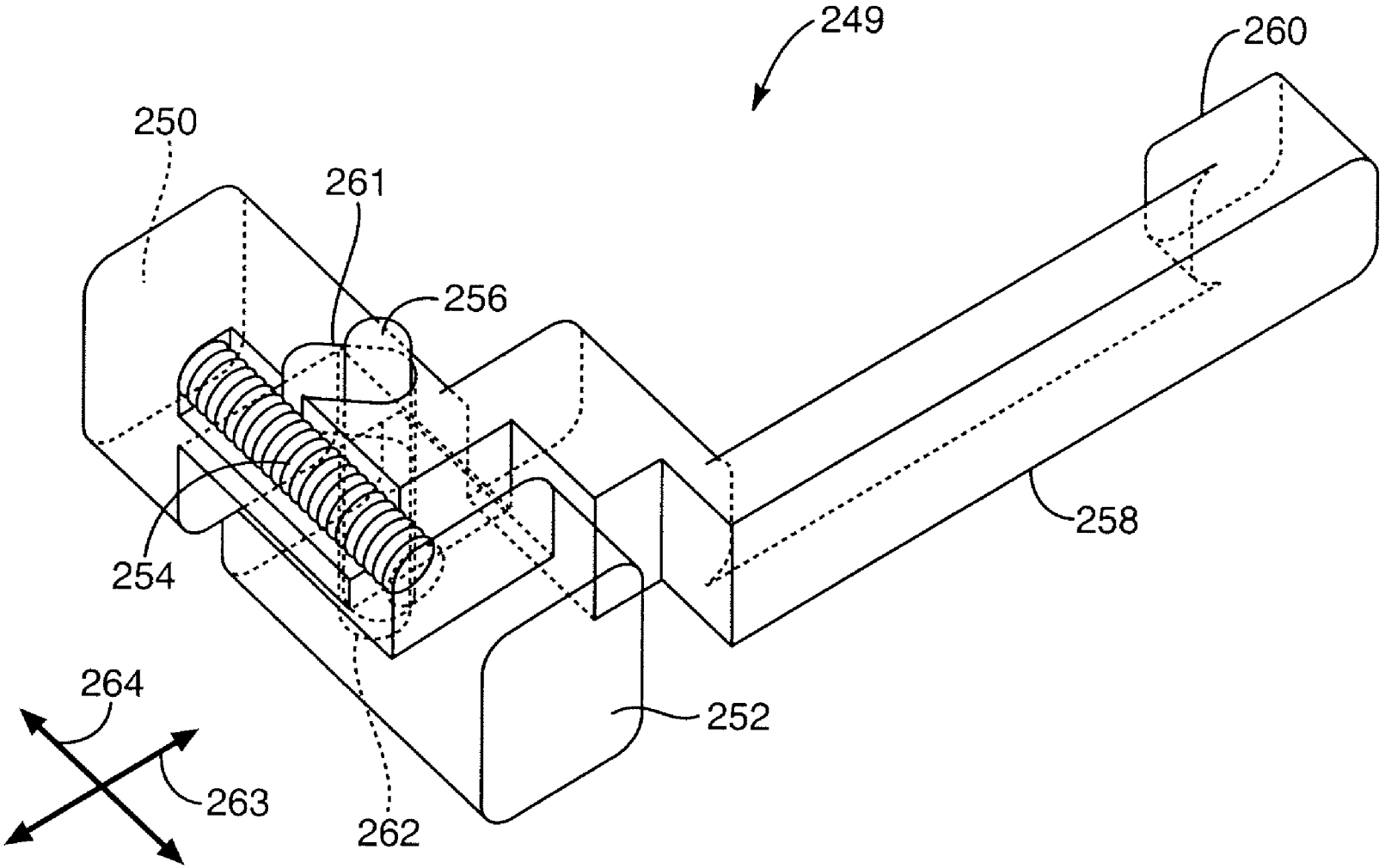
FIG. 8 is a perspective view of a magazine catch system designed for use with M16 type magazines.

FIG. 8 details an alternative configuration of a magazine catch system 249, which comprises a first button 250, a second button 252, a catch biasing spring 254, a catch guide pin 256, and a catch arm 258 having a catch surface 260. The first button 250 is accessible from one side of a firearm and the second button 252 is accessible from the opposite side of the firearm. The first button 250 includes a catch arm 258 and an angled slot 261 extending at an angle to the lateral direction 264. The second button 252 is also formed with the angled slot 262 extending at a different angle than the angled slot 261 of the first button. The catch guide pin 156 extends through the angled slots 261 and 262 and is movable in each slot 261 and 262. The catch biasing spring 254 extends between the first and second buttons 250 and 252.

The magazine catch system 249 works by depressing either the first button 250 or the second button 252 toward the other button, which forces the catch guide pin 256 to move in the angled slots 261 and 262 longitudinally 263. As the catch guide pin 256 moves in the angled slots 261 and 262, the first and second buttons 250 and 252 simultaneously moves laterally 264, toward each other. As both buttons 250 and 252 move toward each other, the catch arm 258 moves to disengage the catch surface 260 from a magazine (not shown).

The invention may incorporate both the bolt hold open system 130 and the magazine catch system 141 into a removable feed attachment device such as a magazine well. However, the bolt hold open system 130 and the magazine catch system 141 may also be incorporated into the receiver of a firearm.

The invention also comprises the use of heat conductive thermoplastics. Heat conductive plastics have recently been developed for use with electric motors, where heat can also be a serious problem. Heat conductive plastics may be used in the invention to form various parts of the firearm.

A major problem with the current use of thermoplastics in firearms is that they begin melting over constant use in a short period of time. Especially in semi-automatic or fully automatic firearms, the barrel, chamber, bolt, gas system, and any associated parts can easily exceed the melting temperature or glass transition phase of any thermoplastics used in those parts. Typical thermoplastics are insulators. Therefore, typical thermoplastics trap heat next to the firearm. Thus, supporting the temperature of the firearm to rise as each round is fired.

Heat conductive plastics have the distinct advantage over standard thermoplastics and thermoplastic composites because heat conductive plastics are able to conduct the heat generated away from the firearm and into the surrounding environment. Conducting heat away from the firearm has the added benefit of helping to prevent "cooking off" round. Cooking off a round is an extremely dangerous occurrence, where the chamber is so hot that the residual heat is able to ignite a round sitting in the chamber and fire the firearm when the user is not expecting.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope. The present invention may be embodied in other specific forms without departing from its spirit or essential characteristics. All of the parts discussed above may be made of metal, composite, or plastics. In addition, the parts may be stamped, cast, forged, or machined. The described embodiments are to be considered in all respects only as illustrative and not restrictive. All changes and alternatives that would be known to one of skill in the art are embraced within the scope of the invention.

The invention claimed is:

1. An improved firearm comprising:

a magazine well;

a trigger guard;

a magazine catch system comprising a first button accessible from a side of the firearm, wherein the first button is disposed in proximity to the trigger guard, wherein depression of the first button releases a magazine disposed within the magazine well;

a bolt hold open system comprising a bolt hold open control arm extending as low as at least a portion of the trigger guard; and wherein the bolt hold open control arm extends along both sides of the trigger guard such that the trigger guard is at least partially nested within the bolt hold open control arm.

2. An improved firearm comprising:

a magazine well;

a trigger guard;

a magazine catch system comprising a first button accessible from a side of the firearm, wherein the first button is disposed in proximity to the trigger guard, wherein depression of the first button releases a magazine disposed within the magazine well;

a bolt hold open system comprising a bolt hold open control arm extending as low as at least a portion of the trigger guard; and wherein the magazine catch system comprises a second button accessible from an opposing side of the firearm, wherein depression of the second button releases the magazine disposed within the magazine well and wherein the magazine catch system is configured so that if the first button is depressed, the second button moves toward the first button.

3. An improved firearm comprising:

a magazine well;

a trigger guard;

a magazine catch system comprising a first button accessible from a side of the firearm, wherein the first button is disposed in proximity to the trigger guard, wherein depression of the first button releases a magazine disposed within the magazine well;

a bolt hold open system comprising a bolt hold open control arm extending as low as at least a portion of the trigger guard; and wherein the magazine catch system further comprises a second button accessible from an opposing side of the firearm, wherein depression of the second button releases the magazine disposed within the magazine well and wherein the magazine catch system further comprises a catch arm having a catch surface, wherein the catch surface engages the magazine to retain the magazine in the magazine well of the firearm, wherein if either button is depressed, the catch surface moves out of engagement with the magazine.

4. The improved firearm of claim 3, wherein the magazine catch system further comprises a catch guide pin extending through the first and second buttons, wherein depression of either button forces the catch guide pin to move and thereby move the opposing button toward the depressed button.

5. The improved firearm of claim 4, wherein the first button includes a first angled slot and the second button includes a second angled slot extending at an angle different than the first angled slot, wherein the catch guide pin is disposed within both angled slots.

6. An improved firearm comprising:

a magazine well;

a trigger guard;

a magazine catch system comprising a first button accessible from a side of the firearm, wherein the first button is disposed in proximity to the trigger guard, wherein depression of the first button releases a magazine disposed within the magazine well;

a bolt hold open system comprising a bolt hold open control arm extending as low as at least a portion of the trigger guard; and wherein the magazine catch system further comprises a second button accessible from an opposing side of the firearm, wherein depression of the second button releases the magazine disposed within the magazine well wherein the bolt hold open control arm is disposed below the first and second buttons.

7. An improved firearm comprising:

a back end;

a barrel;

a magazine well;

a trigger guard;

a magazine catch system comprising a first button accessible from a side of the firearm and a second button accessible on an opposite side of the firearm wherein depression of either button releases a magazine disposed within the magazine well; and a bolt hold open system comprising a bolt hold open control arm extending as low as at least a portion of the trigger guard and located rearward of the magazine well to be in closer proximity to the back end than the magazine well and at least a portion of the bolt hold open control arm located forward of the trigger guard to be in closer proximity to the barrel than the trigger guard.

8. The improved firearm of claim 7, wherein the trigger guard and the bolt hold open control arm are disposed adjacent each other such that a trigger finger of a hand may extend from a position within the trigger guard to a position contacting the bolt hold open control arm while maintaining the same position of a palm of the hand.

9. The improved firearm of claim 7, wherein the bolt hold open control arm is configured to be accessible on an opposing side.

10. The improved firearm of claim 9, wherein the bolt hold open control arm extends along both sides of the trigger guard.

11. The improved firearm of claim 7, wherein the bolt hold open system further comprises a bolt hold open body, wherein the bold hold open body extends through the magazine catch system.

12. The improved firearm of claim 7, further comprising a second button accessible on an opposing side of the first button, wherein depression of the second button releases the magazine disposed in the magazine well.

13. The improved firearm of claim 12, wherein the magazine catch system is configured so that if the first button is depressed, the second button moves toward the first button.

14. The improved firearm of claim 12, wherein the magazine catch system further comprises a catch arm having a catch surface, wherein the catch surface engages the magazine to retain the magazine in the magazine well of the firearm, wherein if either button is depressed, the catch surface moves out of engagement with the magazine.

15. The improved firearm of claim 14, wherein the magazine catch system further comprises a catch guide pin extending through the first and second buttons, wherein depression of either button forces the catch guide pin to move and thereby move the opposing button toward the depressed button.

16. The improved firearm of claim 15, wherein the first button includes a first angled slot and the second button includes a second angled slot extending at an angle different than the first angled slot, wherein the catch guide pin is disposed within both angled slots.

17. The improved firearm of claim 12, wherein the bolt hold open control arm is disposed below the first and second buttons.

18. The improved firearm of claim 7, further comprising a trigger and wherein the distance between a portion of the bolt hold open control arm and the trigger is approximately equidistant to the distance between the first button and the trigger.

19. An improved firearm comprising:

a magazine well;

a trigger guard extending in a first direction substantially perpendicular to a first side of the firearm and in a second direction substantially perpendicular to a second side of the firearm and opposite the first direction;

a magazine catch system comprising a first button accessible from the first side of the firearm wherein depression of the first button releases a magazine disposed within the magazine well; and a bolt hold open system comprising a bolt hold open control arm comprising, a first portion extending in the first direction further than the trigger guard extends in the first direction; and a second portion extending in the second direction further than the trigger guard extends in the second direction.

20. The improved firearm of claim 19, wherein the bolt hold open control arm extends as low as approximately the bottom of the trigger guard.

21. The improved firearm of claim 19, wherein the bolt hold open system further comprises a bolt hold open body, wherein the bold hold open body extends through the magazine catch system.

22. The improved firearm of claim 19, further comprising a trigger and wherein the distance between a portion of the bolt hold open control arm and the trigger is approximately equidistant to the distance between the first button and the trigger.

23. The improved firearm of claim 19, wherein the bolt hold open control arm is disposed below the first button.

24. An improved firearm comprising:

a magazine well;

a trigger;

a trigger guard located proximate to the trigger;

a magazine catch system comprising a first button accessible from a side of the firearm wherein depression of the first button releases a magazine disposed within the magazine well; and a bolt hold open system comprising a bolt hold open control arm extending as low as at least a portion of the trigger guard, wherein the bolt hold open control arm extends along both sides of the trigger guard such that the trigger guard is at least partially nested within the bolt hold open control arm.

25. An improved firearm comprising:

a back end;

a barrel;

a magazine well;

a trigger guard;

a magazine catch system comprising a first button accessible from a side of the firearm and a second button accessible on an opposite side of the firearm, wherein depression of either button releases a magazine disposed within the magazine well; and a bolt hold open system comprising a bolt hold open control arm disposed below the first and second buttons and extending as low as at least a portion of the trigger guard and located rearward of the magazine well to be in closer proximity to the back end than the magazine well and at least a portion of the bolt hold open control arm located forward of the trigger guard to be in closer proximity to the barrel than the trigger guard.

* * * * *

UNITED STATES PATENT AND TRADEMARK OFFICE

CERTIFICATE OF CORRECTION

PATENT NO. : 7,596,900 B2
APPLICATION NO. : 10/911963
DATED : October 6, 2009
INVENTOR(S) : Alexander J. Robinson et al.

It is certified that error appears in the above-identified patent and that said Letters Patent is hereby corrected as shown below:

Column 2, Line 32 reads, "These differences should effect the way..." which should read, "These differences should affect the way..."

Column 4, Line 32 reads, "The Magazine release buttons are the positioned..." which should read, "The Magazine release buttons are positioned..."

Column 4, Line 37 reads, "...fixtures are different depending on feeding device used." which should read, "...fixtures are different depending on the feeding device used."

Column 6, Line 17 reads, "...FIGS. 1 through 9..." which should read, "...FIGS. 1 through 8..."

Column 6, Line 67 reads, "...may accessed on both sides of the firearm 10." which should read, "...may be accessed on both sides of the firearm 10."

Column 10, Line 37 reads, "...the user to may adapt to..." which should read, "...the user may adapt to..."

Column 11, Line 46 reads, "...extends on both side of the trigger..." which should read, "...extends on both sides of the trigger..."

Column 12, Line 36 reads, "...170 and 172 may be, rigidly or slidably attached..." which should read, "...170 and 172 may be rigidly or slidably attached..."

Column 13, Line 56 reads, "...to prevent 'cooking off' round." which should read, "...to prevent 'cooking off' a round."

Signed and Sealed this

Twenty-sixth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,596,900 B2
APPLICATION NO. : 10/911963
DATED : October 6, 2009
INVENTOR(S) : Robinson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1034 days.

Signed and Sealed this

Twenty-eighth Day of September, 2010

David J. Kappos

David J. Kappos
*Director of the United States Patent and Trademark Office*